US005490698A

United States Patent [19]

Dezso

[11] Patent Number: 5,490,698

[45] Date of Patent: Feb. 13, 1996

[54] DOOR LOCKING SYSTEM

[76] Inventor: Paul M. Dezso, 16018 Hartland St., Van Nuys, Calif. 91406

[21] Appl. No.: 270,269

[22] Filed: Jul. 5, 1994

[51] Int. Cl.[6] ..... E05C 1/06

[52] U.S. Cl. ..... 292/138; 292/144; 292/DIG. 25

[58] Field of Search ..... 292/138, 144, 292/145, DIG. 25; 70/DIG. 49

[56] References Cited

U.S. PATENT DOCUMENTS

| | | | |
|---|---|---|---|
| 563,724 | 7/1896 | Arthur . | |
| 3,455,127 | 7/1969 | Simon | 70/277 |
| 3,890,608 | 6/1975 | Peterson | 70/DIG. 49 X |
| 3,995,464 | 12/1976 | Terry | 70/DIG. 49 X |
| 4,453,390 | 6/1984 | Moritz et al. | 70/434 |
| 4,806,910 | 2/1989 | Salzer | 340/547 |
| 4,904,005 | 2/1990 | Frolov | 292/144 X |
| 4,907,429 | 3/1990 | Davis et al. | 70/279 |
| 4,994,722 | 2/1991 | Dolan et al. | 318/480 |
| 5,076,620 | 12/1991 | Campbell | 292/138 |
| 5,095,654 | 3/1992 | Eccleston | 292/144 X |
| 5,100,186 | 3/1992 | Norduall | 292/144 X |
| 5,127,691 | 7/1992 | Herron et al. | 292/144 X |
| 5,311,168 | 5/1994 | Pease, Jr. et al. | 70/DIG. 49 X |
| 5,362,116 | 11/1994 | Doyle et al. | 292/144 |

*Primary Examiner*—Steven N. Meyers
*Assistant Examiner*—Monica E. Millner
*Attorney, Agent, or Firm*—Louis L. Dachs; Alan R. Davis

[57] ABSTRACT

The invention is an automatic door locking system that provides for unlocking of the door to a room from a remote location. In detail, the system includes a door lock that is manually operable by a lever mounted on the room side of the door when the door is locked. An electrical circuit is provided for unlocking the door lock from the remote location such that door can be opened from the opposite side of the door and to reset the door lock to the locked position when the door is closed upon the door being opened. In addition, the electrical circuitry provides visual indication of the status of the door at the remote location.

9 Claims, 3 Drawing Sheets

DOOR LOCKING SYSTEM

BACKGROUND OF THE INVENTION

1. Field of the Invention

The invention relates to the field of door locking systems and, in particular, to a system that unlocks the door from a remote location and the door is automatically set to re-lock upon the opening thereof.

2. Description of Related Art

There has long been a need for a device to unlock a door to a room from a remote location and provide for an indication at the remote location of the status of the door. The most obvious example are public rest rooms in gas stations. Often gas stations are operated by a single proprietor. For safety purposes, the proprietor is obviously required to remain next or near the cash register. In many gas stations that offer only self service gas, they remain in a bullet proof booth. Additionally, there is a need to maintain the rest room in a locked condition, as a safety precaution for patrons. In the past, the door was kept locked and the patron had to request a key from the proprietor. This proved unacceptable, for many people did not return the key. Even if they did, there was no way to tell whether the door was in fact closed, let alone locked.

U.S. Pat. No. 563,724, "Annunciator System For Buildings" by J. M. Arthur solved the door status problem. J. M Arthur's solution is an electrical door lock indication system that would indicate the status of the lock at a remote location. However, this invention did not address the need for locking the door after an individual left the room. In U.S. Pat. No. 4,453,390, Combination Lock Monitoring System" by P. G. Moritz, et. al. a system is disclosed for monitoring the condition of a combination lock; however; it had the same short of short comings as the J. M. Author system.

In U.S. Pat. No. 3,455,127, "Lock Control System" by H. Simon a system is disclosed for unlocking a door from a remote location. In this system, actuation by a key from the remote location electrically actuates a door retainer (striker) to unlock the door for a set period of time, thereafter the door would automatically relock. However, this system has proven to have several short comings, which include the fact that often the rest room is located some distance from the proprietor and, thus, the door often relocked before the patron reached it. In addition, no indication is provided at the proprietor's station that the patron has entered the rest room or that the door has relocked. Sometimes rest rooms are used for illegal transactions and the "patron" has kept the door to the rest room open so that others could join in. Thus, it is important for the proprietor to know the status of the door (unlocked, locked and open). In U.S. Pat. No. 4,994,722, "Automated Door Locking System For Aircraft Lavatory" by D. C. Dolan, et. al. a system is disclosed for locking a lavatory door on an aircraft from a remote location (pilot compartment). An infrared sensing system is use to determine the presence of a person in the lavatory and if it is not in use, the door is locked. If in use, the system is recycled until the person is no longer sensed within the lavatory. However, while this system could be adapted to provide locking of the a rest room and the like from a remote location, it is to complicated and expensive for us in most applications such as rest rooms for gas stations and the like.

Thus, it is a primary object of the invention to provide a door locking system that provides for the unlocking of the door from a remote location.

It is another primary object of the invention to provide a door locking system that provides for the unlocking of the door from a remote location and automatic resetting of the door to a locked condition upon the opening of the door.

It is a further object of the invention to provide a door locking system that provides for the unlocking of the door along with its status from a remote location.

SUMMARY OF THE INVENTION

The invention is a door locking system for a room that allows the room to be unlocked from a remote location. In general terms, the door locking system includes a door lock that is manually operable by a lever mounted on the room side of the door when the door is locked. The door lock includes a door locking bolt movably mounted in the door and a solenoid operated door lock striker mounted in the frame of the door positioned to receive the locking bolt in un-lockable engagement when the door is in the closed position. The lever is operatively connected to the door locking bolt such that movement of the lever disengages the locking bolt from the door lock striker when the door is in the closed position.

A circuit assembly is included that provides for the unlocking of the door from the remote location such that the door can be opened from the opposite side thereof. The circuit assembly also provides for resetting of the door lock to the locked position when the door is closed upon the door being opened. In addition, the circuit assembly provides for visual indication of the status of the door (closed and locked, closed and unlocked, and open or ajar). A buzzer is also provided at the remote location that sounds when the door is open.

The circuit comprises the following components and operates in the following manner. With the door in the locked position, a power supply is coupled to first and second switches (in their first positions) of a solenoid operated relay. Power from the power supply is directed through the first switch of the relay to a green light on the control panel causing it to illuminate. This indicates to the proprietor that the door is in its normal closed and locked condition. When the proprietor at the counter momentarily depresses a third switch on the control panel, that is spring biased to the off condition, power is provided to the solenoid of the relay actuating the first and second switches to their second positions. The actuation of first switch to its second position disconnects power to the green light, and connects electrical power to a red light, which is also mounted on the control panel. This causes the red light to illuminate indicating that the door is unlocked. With the second switch now in the second position, power from the power supply is provided to the solenoid operated striker mounted in the door frame unlocking the door. This will allow a patron to open the door by just "pulling on" the outside door handle.

Upon depressing of the actuation switch, power is also supplied to the solenoid of the relay through the first switch thereof and a normally closed fourth switch of the double pole/double throw magnetic switch in the door frame. The magnetic switch is controlled by a magnet mounted in the edge of the door. Thus even after the third switch is released disrupting power to the solenoid, power is still applied thereto and it remains latched and the striker also remains released (the door remains unlocked).

When the door is opened, the door mounted magnet moves out of proximity of the magnetic switch causing the normally closed fourth switch therein to open de-energizing the relay and also causes a normally open fifth switch to close that supplies power to a yellow light on the control panel, indicating that the door is ajar. It also activates a buzzer mounted on the control panel, and re-energizes the green light. This also causes the first and second switches of the relay to move back to their first positions extinguishing the red light and disconnecting power to the door striker. It can be clearly seen that once the door is again closed, the fourth switch of the magnetic switch recloses and the normally closed fifth switch thereof opens extinguishing both the buzzer and yellow light. The door is now locked with only the green light remaining lit.

Once inside the room, the patron can then bolt the door from the inside using the manual lock. When the patron, upon opening the door to leave the room, causing the fourth switch of the magnetic switch assembly to open while the third switch closes. Thus, the yellow light comes on and the buzzer sounds. However, the relay is not actuated and the striker remains latched. Upon re-closing of the door by the patron, the circuit again returns to its original condition.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

DESCRIPTION OF THE PREFERRED EMBODIMENT

Figure 1:
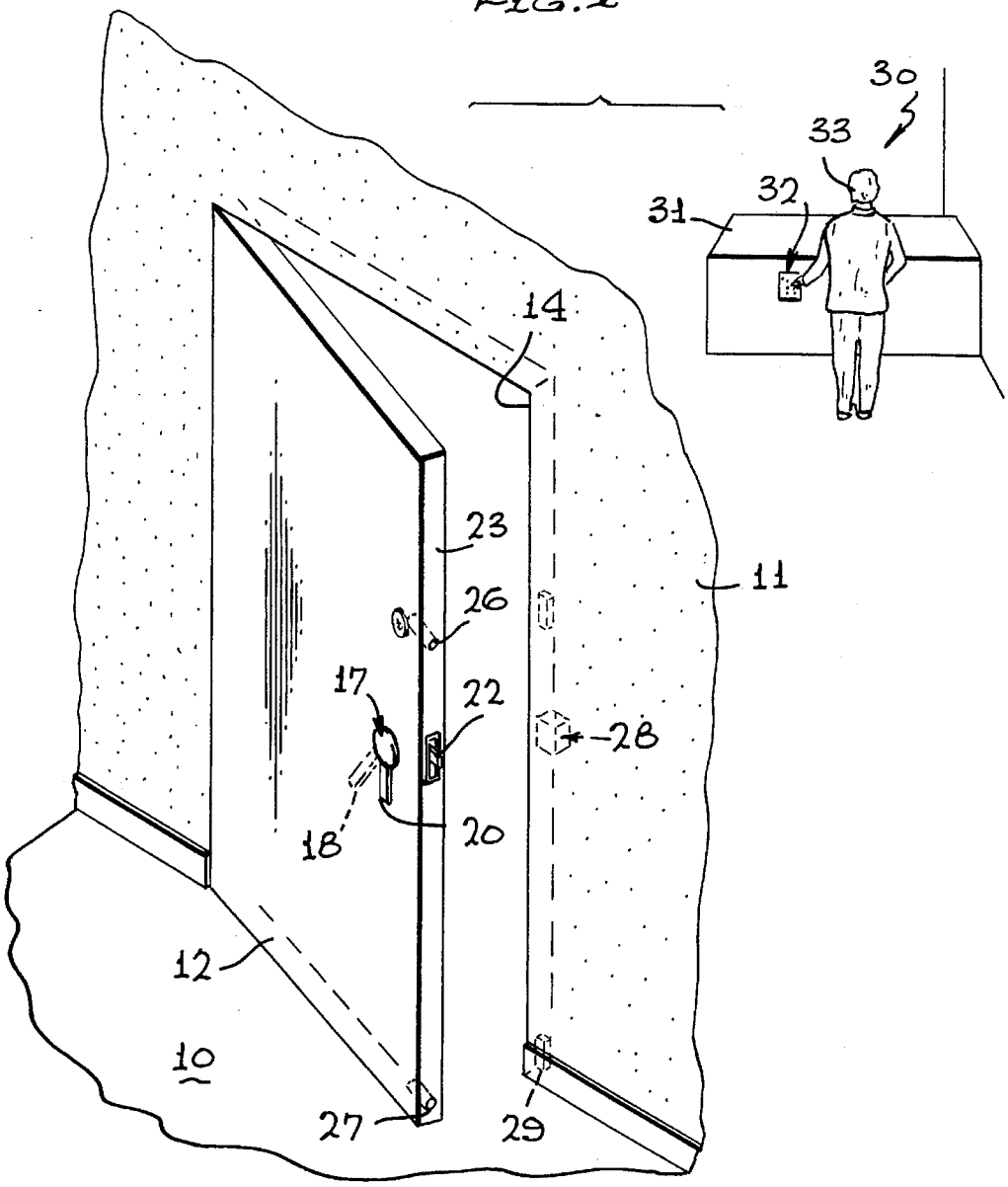
FIG. 1 is a partial perspective view of a room incorporating the subject door locking system.
Figure 3:
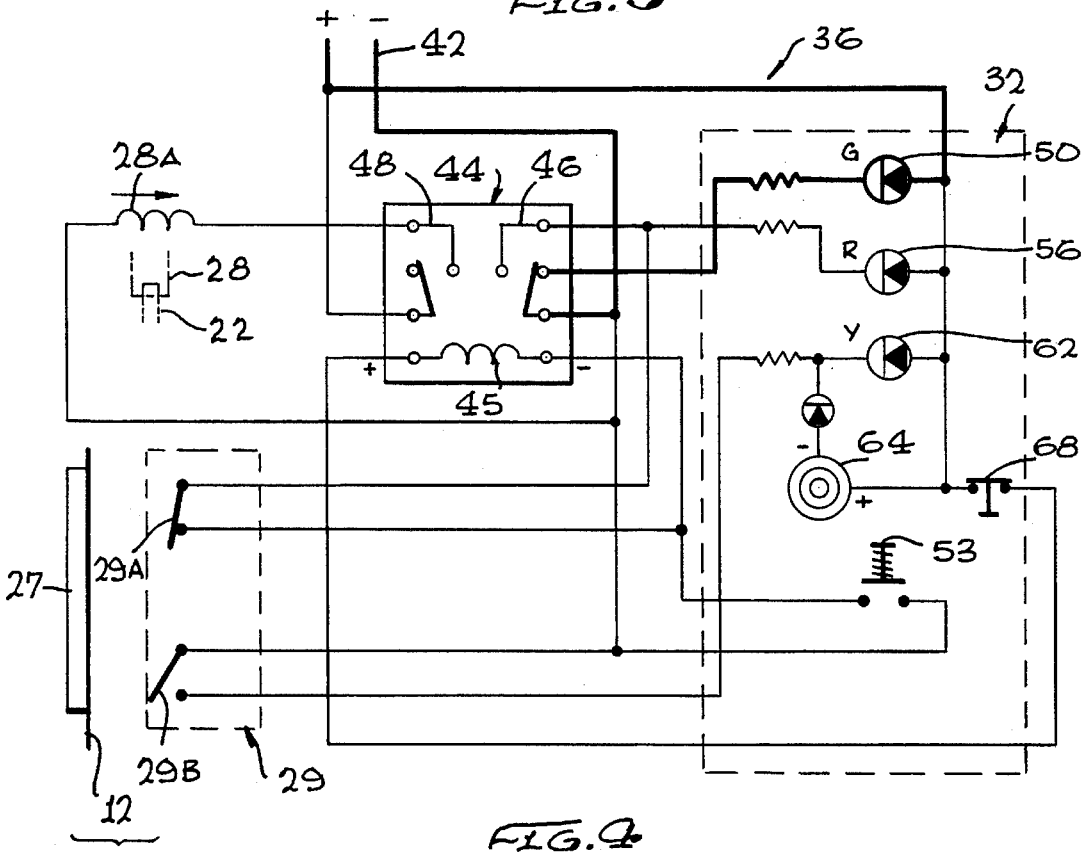
FIG. 3 is a schematic of the control circuit for the subject door locking system in the "door secure position."

A portion of a room is illustrated in FIG. 1, 8 generally indicated by numeral 10. The room 10 includes a wall 11 having a door 12 pivotally mounted to a door frame 14 in the wall. A door lock 17 is mounted in the door having door handles 18 and 20 on both the room side and outside side, respectively, of the door 12, for operating a locking bolt 22 mounted in the door edge 23. The door lock 17 is a typical off-the-shelf type having the room side door handle 18 always in an operating condition and the door handle 20 inoperable unless unlocked by a key (not shown). A dead bolt 26, operable only from the inside of the room is also mounted on the door 12. Additionally, a magnet 27 is mounted in the door edge 23. A standard off-the-shelf solenoid operated door striker 28 is mounted in the door frame 14 that is engagable by the locking bolt 22, when the door is closed. Such solenoid operated door strikers are available from Ruthford Controls, Ltd., Security Door Controls, Westlake Village, Calif., and Architectural Security Products, Lemont, Ill. to name a few. A double pole/double throw magnetic switch assembly 29 is also mounted in the door frame 14 that is actuated by the magnet 27 when the door is closed. Referring momentarily to FIG. 3, the switch assembly has a normally closed switch 29A and a normally open switch 29B. Again referring to FIG. 1, at a remote location 30, some distance from the room 10, is a service counter 31 having a control box 32 mounted thereon. For purposes of illustration it is shown within the line-of-sight of an individual (a proprietor), indicated by numeral 33. However, it must be noted that it is not a necessity to have such line-of-sight to operate the invention.

Figure 2:
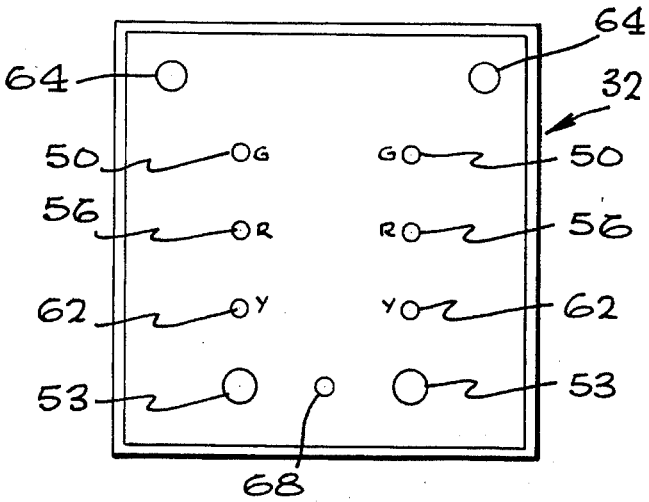
FIG. 2 is a front view of the control panel located at the remote location used to operate the door locking system.

A front view of the control panel 32 is provided in FIG. 2. Note that the control panel incorporates controls for two rooms, typically, woman and men's rest rooms. FIGS. 3 through 6 depict the complete control circuit for the door locking system in its various operational conditions. For clarification purposed, in FIGS. 3–6 the parts of the complete circuit assembly, generally indicated by numeral 36, that are energized at any one time and in operation are depicted in heavy lines. Still referring to FIG. 1 and additionally to FIGS. 2–6, with the door in the locked position, the circuit assembly 36, is in the condition as shown in FIG. 3. A power supply 42 is coupled to a relay 44. Typically, the power supply would by an AC to DC transformer (not shown) coupled to an normal AC power outlet. The relay 44 includes a solenoid 45 for operating the two switches 46 and 48 shown in their normally closed first positions. In this configuration, power from the power supply 42 is directed through switch 46 to a green light 50 on the control panel 32 causing it to illuminate. This indicates to the proprietor 33 that the door is in its normal closed and locked condition.

Figure 4:
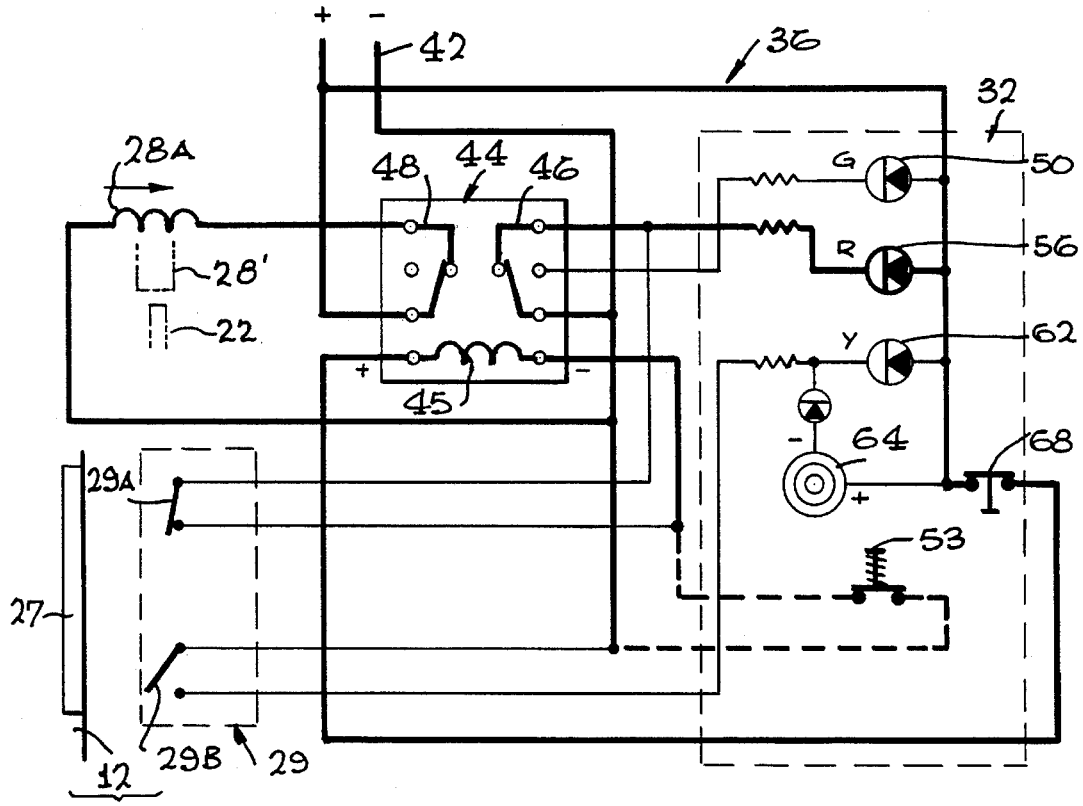
FIG. 4 is a schematic of the control circuit for the subject door locking system shown in FIG. 3 in the "initial door unlocked position."

Referring particularly to FIG. 4, when the proprietor 33 at the counter 31 wishes to allow a patron to enter the room 10, he or she momentarily depresses an actuation switch 53, spring biased to the off condition, on the control panel 32. Power is provided to the solenoid 45 of the relay 44 actuating switches 46 and 48 to their second positions. The actuation of switch 46 to its second position, of course, disconnects power to the green light 50, and provides electrical power to the red light 56, which is also mounted on the control panel 32, causing it to illuminate indicating that the door 12 is unlocked. With switch 48 now in the second position, power from the power supply 42 to connected to the solenoid 28A of the striker 28 mounted in the door frame 14 unlocking the door 12 by moving the striker to position 28'. This will allow a patron to open the door by just "pulling on" the handle 20. Upon release of the actuation switch 53, the circuit is in the position as indicated in FIG. 4A.

Figure 5:
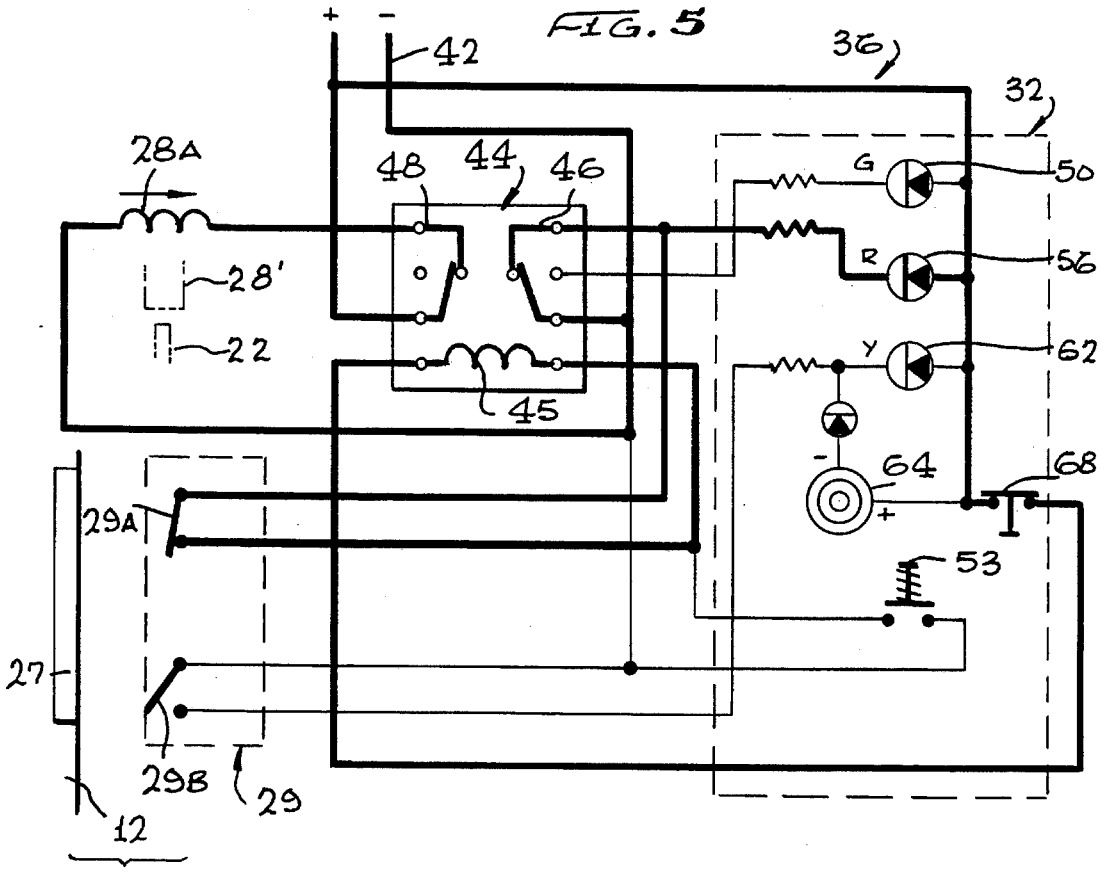
FIG. 5 is a schematic of the control circuit for the subject door locking system shown in FIG. 3 in the "door unlocked position."

Referring now to FIG. 5, it can be seen that upon depressing of the switch 53 power is also supplied to the solenoid 45 of the relay 44 through the normally closed switch 29A of the switch assembly 29 in the door frame 14. Thus even after the switch 53 is released, power is still applied to the solenoid 45 of the relay 44 and it remains latched. The striker 28 also remains and remains in position 28' (the door remains unlocked).

Figure 6:
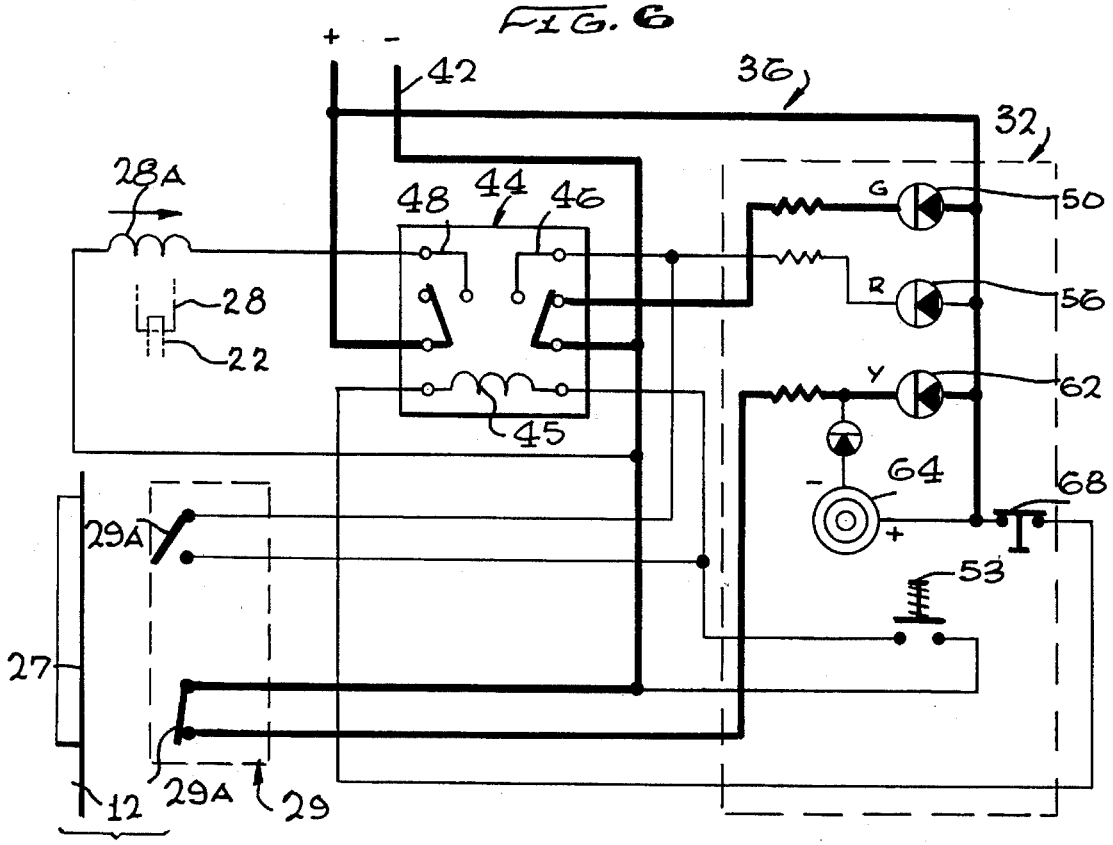
FIG. 6 ms a schematic of the control circuit for the subject door locking system shown in FIG. 3 in the "door open position."

In FIG. 6, it can be seen that, when the door 12 is opened, the door mounted magnet 27 moves out of proximity of the magnetic switch 29 causing switch 29A to open de-energizing the solenoid 45 of the relay 44 and also causes normally open switch 29B to close and power is now provided to a yellow light 62 and a buzzer 64 mounted on the control panel 32, indicating that the door is ajar. The green light 50 is also re-energized. With power cut off to the relay 44, the switches 46 and 48 of the relay 44 move back to their first positions extinguishing the red light 56 and removing power from the striker solenoid 28A allowing the striker to return to the position indicated by numeral 28. It can be clearly seen that once the door 12 is again closed the switch 29A closes and the switch 29B opens extinguishing both the buzzer 64 and yellow light 62 and the circuit assembly 36 is again in the configuration shown in FIG. 3 with only the green light 50 remaining lit. Note that at anytime after the door is unlocked, the proprietor can reset the circuit 36 by momentarily depressing switch 68 (spring biased to the closed position) which will effectively deactivate the relay 44 and return the circuit to the condition as shown in FIG. 3.

Once inside the room 10, the patron can then bolt the door from the inside using lock 26. When the patron leaves the room 10, upon opening the door 12, the switch 29A of the magnetic switch 29 opens while switch 29B closes. Thus, while the yellow light 62 comes on and the buzzer 64 sounds, the relay 44 is not actuated because switch 46 is in its first position. Upon re-closing of the door 12 by the patron, the circuit assembly 36 again returns to the condition set forth in FIG. 3.

Thus it can be seen that all the objects of the invention are met. The door 12 can be unlocked from the remote location 31 and the red light provides the proprietor with such an indication. When the door is opened the yellow light 62 and green light 50 come on and the buzzer 64 sounds indicating that the door 12 is open, but the door is set to relock upon closing. When the patron leaves the room 12, the yellow light 62 again comes on and the buzzer 64 sounds. After the patron closes the door, the green light 50 only remains lite. Note that should the yellow light 62 and buzzer 64 sound thereafter, the proprietor will know that the patron has not left the room and can thereafter investigate.

While the invention has been described with reference to a particular embodiments, it should be understood that the embodiment is merely illustrative as there are numerous variations and modifications which may be made by those skilled in the art. Thus, the invention is to be construed as being limited only by the spirit and scope of the appended claims.

INDUSTRIAL APPLICABILITY

The invention has applicability to the building industry and, additionally, the lock manufacturing industry.

I claim:

1. An automatic door locking system that provides for unlocking of the door to a room from a remote location, the system comprising:

a door lock comprising:

a door locking bolt movably mounted in the door;

a door lock striker mounted in the frame of the door positioned to receive said locking bolt when said door is in the closed position, said door lock striker in a first condition when the door is locked and in a second condition when said door is unlocked;

a first lever mounted on the room side of door manually operable to move said locking bolt out of engagement with said door lock striker when said door lock striker is in said first position; and a second lever mounted on the opposite side of the door, said second lever inoperable to disengage said door locking bolt from said door lock striker when said door lock striker is in said first position and disengages said locking bort from said door lock striker when the door is in the closed position and said door lock striker is in said second condition;

an electrical circuit means to unlock said door lock from the remote location by placing said door lock striker in said second condition such that the door can be opened by said second lever and, when the door is opened, automatically resets the door lock to the locked condition; and power supply means coupled to said electrical circuit means.

2. The system as set forth in claim 1 wherein said door lock striker is solenoid operated.

3. The system as set forth in claim 2 wherein said electrical circuit means comprises:

a self latching relay circuit having a solenoid operated relay, said relay having a first switch adapted to actuate said door lock sticker to said second condition and to self latch said relay such that it continues to maintain said door lock striker in said second condition upon receipt of a relay actuation signal;

a second switch mounted in the remote location for momentarily providing the relay actuation signal to said solenoid of said relay latching said relay; and a third switch for interrupting the relay actuation signal, unlatching said relay, said third switch actuated upon the opening of the door allowing said door lock striker to return to said first condition.

4. The system as set forth in claim 3 rein said second switch of said relay also provides electrical power to said relay circuit after said second switch is released and no longer provides electrical power maintaining said relay in the latched position.

5. The system as set forth in claim 4 wherein said electrical circuit means further includes a double throw/double pole magnetic switch assembly mounted in the door frame actuated by a magnet mounted in the door and said third switch is included therein.

6. The system as set forth in claim 5 wherein said electrical circuit means includes a first light to indicate the status of door when closed and locked, a second light to indicate the status of the door when closed and unlocked and a third light to indicate the status of the door when open.

7. The system as set forth in claim 6 wherein said relay circuit includes a fourth switch, said forth switch coupling said power supply to said first light when said solenoid actuated relay is unlatched and the door is closed and said door lock striker is in said first condition and disconnecting said power supply from said first light and providing power to said second light when said solenoid actuated relay is latched and the door lock striker is in said second position.

8. The system as set forth in claim 7 wherein a fifth switch is included in said magnetic switch assembly for coupling said power supply to said third light when the door is ajar and for the disconnecting therefrom when the door is closed.

9. The system as set forth in claim 8 wherein said fifth switch also couples said power supply to a buzzer when the door is ajar and for disconnecting therefrom when the door is closed.

* * * * *